US006210132B1

(12) United States Patent
Shiinoki et al.

(10) Patent No.: US 6,210,132 B1
(45) **Date of Patent: *Apr. 3, 2001**

(54) PARTITION MEANS FOR DIRECTING AIR FLOW OVER A COOLER IN AN OILLESS SCROLL COMPRESSOR

(75) Inventors: Kazuaki Shiinoki; Isamu Kawano; Natsuki Kawabata; Akira Suzuki, all of Shimizu (JP)

(73) Assignee: Hitachi, Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/921,798

(22) Filed: Sep. 2, 1997

(30) Foreign Application Priority Data

Sep. 20, 1996 (JP) ..... 8-249763

(51) Int. Cl.[7] ..... F04B 17/00

(52) U.S. Cl. ..... 417/410.5; 417/368; 417/372; 417/201; 418/55.6; 418/101

(58) Field of Search ..... 417/410.5, 201, 417/368, 371, 372, 373; 418/55.6, 101

(56) References Cited

U.S. PATENT DOCUMENTS 4,725,210 * 2/1988 Suzuki et al. ..... 418/101
4,929,161 * 5/1990 Aoki et al. ..... 418/101
5,507,618 * 4/1996 Kubo et al. ..... 415/182.1
5,556,269 * 9/1996 Suzuki et al. ..... 418/101

FOREIGN PATENT DOCUMENTS 1597-223 * 9/1981 (GB) ..... 417/372
7-158582 * 6/1995 (JP) ..... 417/410.5
10024729 * 1/1998 (JP) ..... 417/371

OTHER PUBLICATIONS

Whilte, Frank; Heat Transfer; pp. 70–71 and 81, Jan. 1984.*

* cited by examiner

*Primary Examiner*—Charles G Freay
*Assistant Examiner*—Cheryl J. Tyler
(74) *Attorney, Agent, or Firm*—Antonelli, Terry, Stout & Kraus, LLP

(57) ABSTRACT

A cooling fan is fitted to one of the shaft end portions of a double-end motor, and a pulley is fitted to the other end portion. A belt is passed around this pulley and a pulley fitted to a compressor element, and the compressor element is driven by this belt. The compressor element is disposed in such a manner as to be stacked up in an upward direction of the motor. An exhaust duct having a built-in cooler is also disposed in such a manner as to be stacked up above a cooling fan on the discharge side of the cooling fan. A main duct is formed on the suction side of the cooling fan and is interconnected in series with a cooling air outlet of the compressor element. These members described above are accommodated inside a casing. Therefore, two cooling air flow passages are defined on the right and left sides inside the casing.

19 Claims, 5 Drawing Sheets

PARTITION MEANS FOR DIRECTING AIR FLOW OVER A COOLER IN AN OILLESS SCROLL COMPRESSOR

BACKGROUND OF THE INVENTION

This invention relates to a compressor of the type used for air compressor, refrigeration, air-conditioning, etc., and more particularly to an oil-free scroll compressor.

An oil-free scroll compressor, which does not use oil, such as a lubricating oil, for the flow passage of the operation gas, is a well known compressor for use in air compressor, refrigeration, and air condition. In this oil-free scroll compressor, two sealed spaces are defined by wraps and end plates on the outer wall surface of an orbiting scroll wrap and a stationary scroll wrap by combining the orbiting scroll and the stationary scroll, each of which is equipped with spiral wraps perpendicular to an end plate, while the inside of the wraps face one another. The sealed spaces move towards the center portion due to the relative motion of both scrolls. As their volumes thus decrease, a gas sucked from the outer peripheral sides of these scrolls is compressed and is discharged from a discharge port disposed at the center portion of the stationary scroll. When the operation gas is compressed in this way by the relative motion of the orbiting scroll and the stationary scroll, the scroll compressor generates heat. This also holds true for other types of compressors handling gas. Japanese Patent Laid-Open No. 217580/1995 describes a two-stage oil-free screw compressor having a small capacity of 22 kW to 37 kW, for example, wherein the first stage discharge air temperature reaches about 190 to about 240° C. Therefore, in the scroll compressor which is of the same displacement type, heat generation of a similar level can be expected if the compressor ratio, etc., is the same.

When the compressor generates heat, the clearance of each portion of the compressor changes from the design value due to thermal deformation, and the compressor becomes less reliable. At the same time, performance of the compressor drops due to a leakage from clearances caused by the thermal deformation, etc. Therefore, a cooling system for effectively guiding the heat generated inside the compressor to the outside has been necessary, and an example of such a system is described in Japanese Patent Laid-Open No. 217580/1995 and Japanese Utility Model Laid-Open No. 104384/1983.

According to Japanese Laid-Open No. 217580/1995, a pre-cooler for primarily cooling a gas discharged from a low pressure stage compressor element is interposed between the low pressure stage compressor main body and an intercooler in a two-stage oilless scroll compressor, and this pre-cooler is accommodated inside an exhaust duct and is cooled by exhaust air flowing through each cooler. This technique retains the effect of dissipating heat generated by the scroll compressor from the compressor to a certain extent, but is not yet sufficient for improving the reliability by cooling the compressor as a whole. In other words, though this approach considers how to cool the cooler on the discharge side of the cooling fan, it does not take cooling of the compressor element disposed on the suction side into consideration. In this regard, if the compressor element which generates a high compression heat is cooled by air, the mass of cooling air increases and a problem develops in that the noise increases due to the increase of a flow velocity inside the exhaust duct. Additionally, the compressor element, the cooling fan, the cooler, etc., are disposed plane-wise, and require a large installing space. Therefore, a reduction of the size of the compressor can not be achieved.

According to Japanese Utility Model Laid-Open No. 104384/1983, on the other hand, a compressor driven by a vertical motor is disposed below the motor, a blower is disposed above the motor, and they are accommodated in a casing so as to cool the compressor as a whole using the blower. According to this technique, however, the air steam around each portion of the compressor changes depending on the flow passage resistance, and all the heat generating portions cannot always be cooled.

SUMMARY OF THE INVENTION

It is therefore a main object of the present invention to achieve a low noise oil-free scroll compressor which can eliminate the problems described above.

It is another object of the present invention to achieve an oil-free scroll compressor which does not need a large installing space.

An oil-free scroll compressor, of the type to which the invention applies, comprises scroll compressor element having an orbiting scroll and a stationary scroll; a motor for driving the scroll compressor element; a cooler for cooling an operation gas compressed by the scroll compressor element; a cooling fan for blasting cooling air subjected to heat-exchange with the operation gas by the cooler; and a casing for accommodating these members. A first embodiment of the present invention for accomplishing the objects described above employs a construction wherein partition means for partitioning a suction flow passage and a discharge flow passage of the cooling fan is provided in the casing. Preferably, this partition means divides the inside of the casing into two chambers with the suction side of the cooling fan as a part thereof.

Preferably, a dryer for dehumidifying the operation gas cooled by the cooler is accommodated in the casing, a discharge port for cooling air is formed on the ceiling plate portion of the casing, a suction port for cooling air is formed on the side portion of the casing, and a first flow passage, through which cooling air introduced via the suction port flows from above to below, a second flow passage, through which cooling air flows from below to above to flows out via the discharge port, and a third flow passage, connecting the first and second flow passage, are exclusively disposed in the casing. Preferably, the second and third flow passages are constituted by a duct respectively.

A second embodiment of the present invention for accomplishing the objects described above employs a construction wherein the motor and the scroll compressor elements are disposed in a stratified form, and the cooling fan and the cooler are disposed in a stratified form. These two stratified arrangements are preferably juxtaposed on the floor surface of the casing.

Preferably, the casing is shaped into a rectangular parallelepiped, the motor is accommodated at the lowermost portion of this rectangular parallelepiped through insulating means for vibration-insulation from the casing, the duct is disposed above the motor, the scroll compressor element is disposed above the duct, a dryer for dehumidifying the operating as compressed by the scroll compressor element, the cooler is interconnected to the scroll compressor element, partition means is a duct defining the cooler and the cooling fan from other members, an exhaust port is formed on the ceiling plate side of the casing, and a suction port is formed on the side surface of the casing on the opposite side to the cooling fan.

Further, a first flow passage through which cooling air flows from above to below, a second flow passage through which cooling air flows from below to above and a third flow passage which connects these first and second flow passages are exclusively disposed inside the casing. Further, the second and third flow passages are preferably constituted by a duct.

In an oil-free scroll compressor of the type wherein a scroll compressor element, a motor and a cooler accommodated inside a casing are cooled by a cooling fan fitted to a double-end motor, the third embodiment of the present invention for accomplishing the afore-mentioned objects comprises a duct for communicating the suction side of the cooling fan and the scroll compressor elements; and an exhaust duct with a built-in cooler disposed on the discharge side of the cooling fan. Preferably, the duct and the exhaust duct are disposed in such a manner as to cross each other substantially orthogonally.

Preferably, a duct for communicating the suction side of the cooling fan and the scroll compressor element and an exhaust duct with a built-in cooler on the discharge side of the cooling fan are disposed, and the distance from the shaft end portion of the scroll compressor element to the end portion of the cooler in the motor axial direction is smaller than the distance from the end of the motor opposite to the cooling fan fitting end to the end face of the cooling fan.

In each of the embodiments described above, cooling means comprising a plurality of fins are preferably disposed on both side surfaces of the scroll compressor element in a direction orthogonal to the axis of rotation inside the scroll compressor element. It is particularly preferable for the orbiting scroll of the scroll compressor element to be a double scroll equipped with spiral wraps on both sides of an end plate.

Each of the embodiments of the present invention provides the following functions and effects. The cooler is disposed on the discharge side of the cooling fan and the duct is interconnected to the suction side of the cooling fan. Since the compressor element is disposed on the upstream side of the duct, air after cooling the compressor element is sucked by the fan and flows into the cooler. Therefore, the cooler is cooled by outside air, the quantity of cooling air can be reduced, the discharge flow velocity drops, and a lower noise can be expected.

Because the compressor element and the cooler are disposed above the double-end motor, the area of installation can be reduced.

BRIEF DESCRIPTION OF THE DRAWINGS

FIGS. 1 to 3 shown an oil-free scroll compressor according to an embodiment of the present invention, wherein:

FIG. 1 is a longitudinal sectional view of the scroll compressor;

FIG. 2 is its front view; and

FIG. 3 is its side view.

FIGS. 4 to 6 show an example of an oil-free scroll compressor element used for the embodiment shown in FIGS. 1 to 3, wherein:

FIG. 4 is a transverse sectional view of the oil-free scroll compressor element;

FIG. 5 is its front view; and

FIG. 6 is its bottom view.

DETAILED DESCRIPTION OF THE DRAWINGS

Hereinafter, a preferred embodiment of the present invention will be explained with reference to FIGS. 1 to 6.

Figure 1:
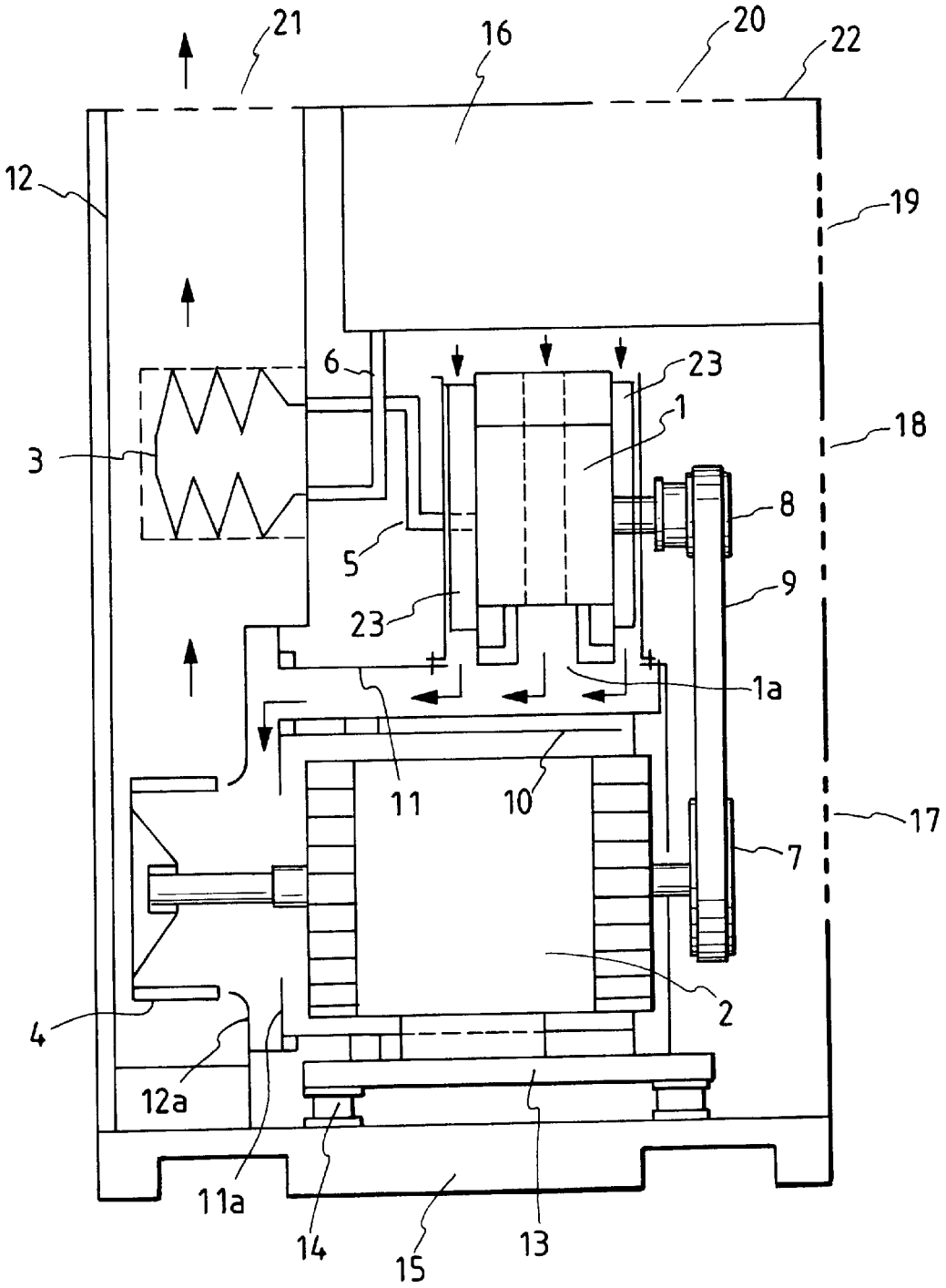
Figure 2:
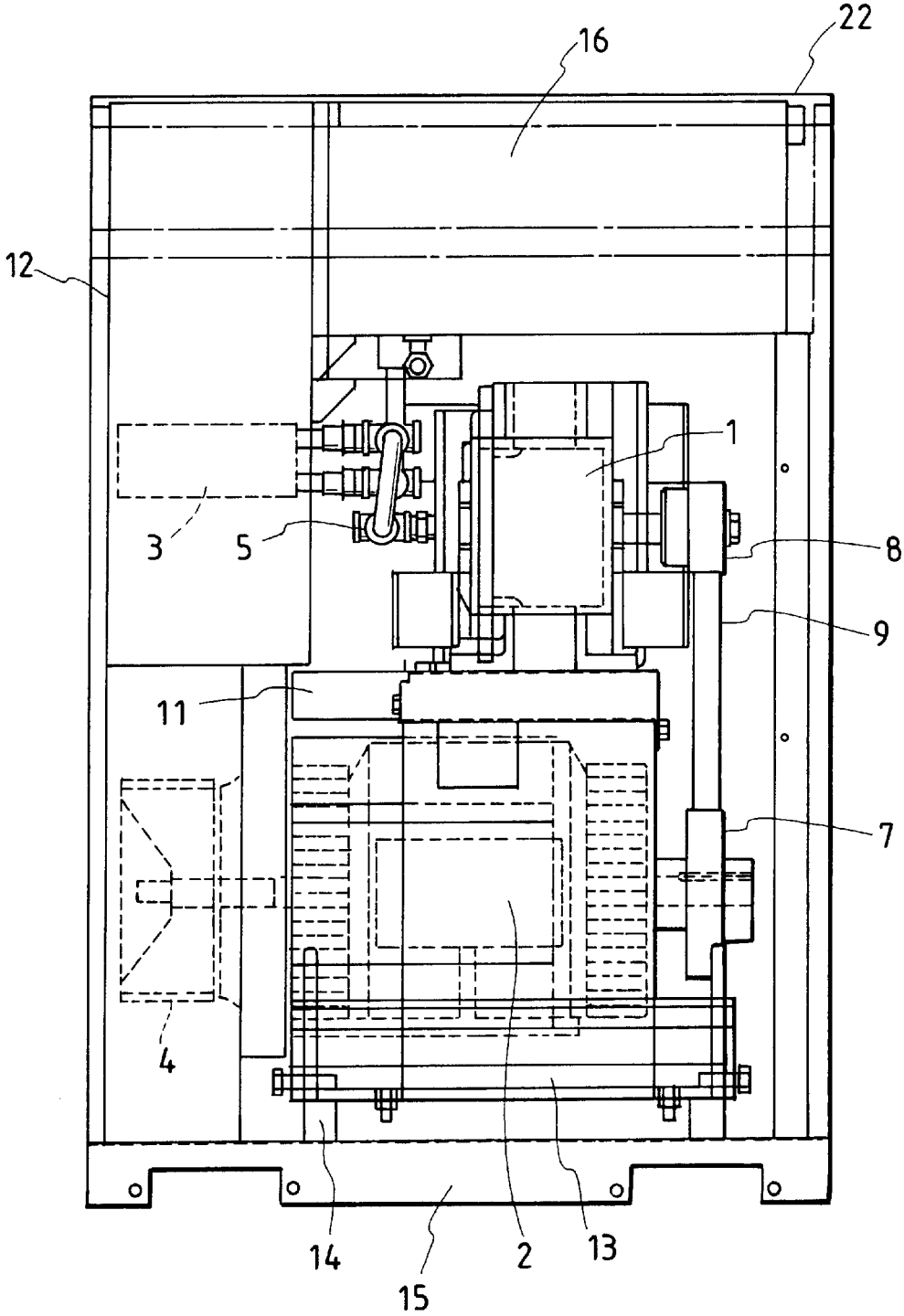
Figure 3:
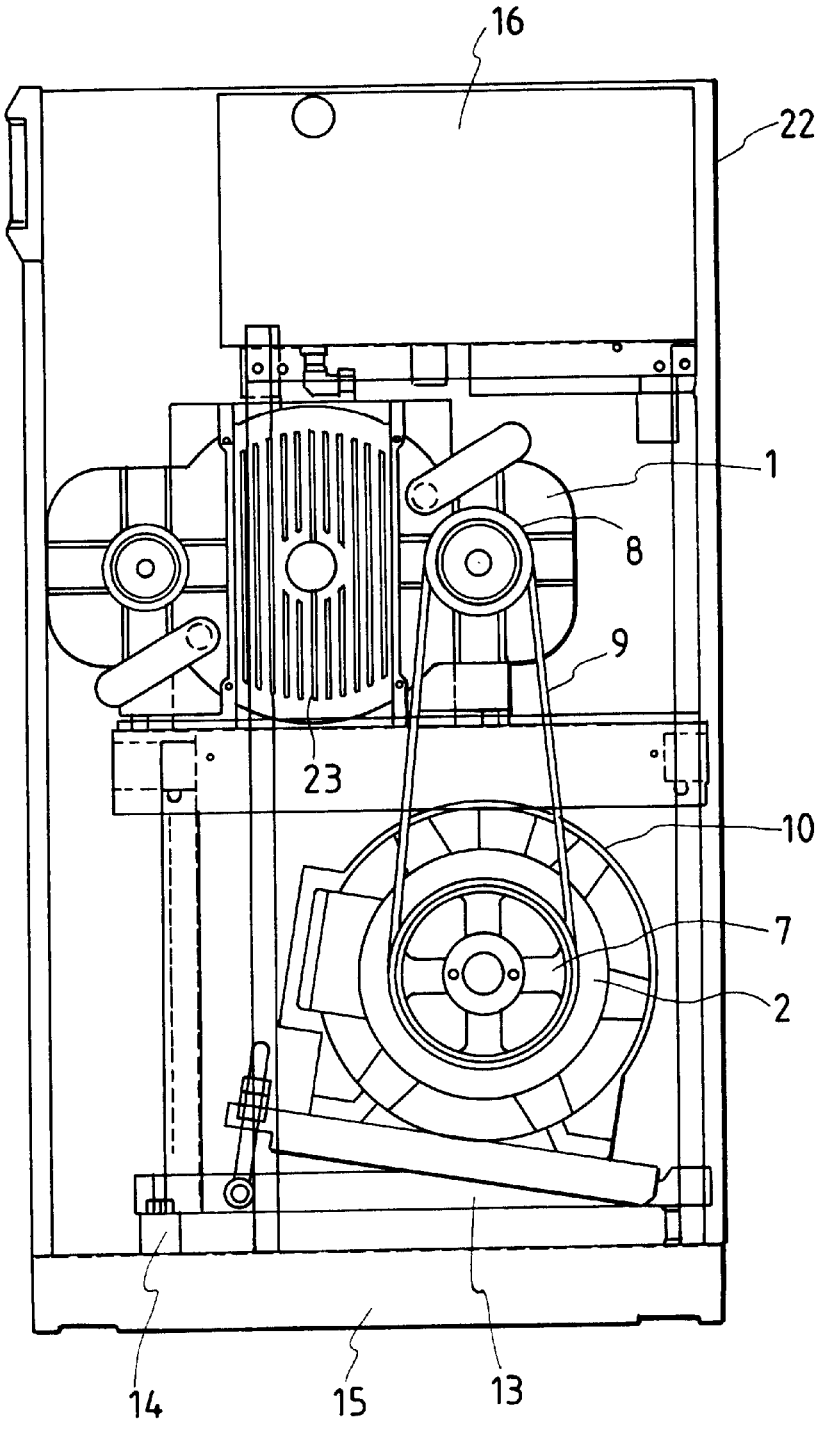

FIG. 1 is a longitudinal sectional view of an oil-free scroll compressor according to a preferred embodiment of the present invention, and FIGS. 2 and 3 are a front view and a side view of the oil-free scroll compressor, respectively. Referring to FIG. 1, reference numeral 1 denotes a compressor element, reference numeral 1*a* denotes a cooling air outlet of the compressor element 1, and reference numeral 2 denotes a double-end motor equipped with a cooling fan 4 on its shaft on one of the sides and with an M sheave 7 for driving the compressor element on its shaft on the other side. The motor 2 and the compressor element 1 are disposed on respective stages of a motor base 13, which is constituted into two states. The motor base 13 is installed on a common base through a vibration-isolation rubber mounting 14 so as to insulate with respect to the vibration of the common base 15.

A V-pulley 8 is fitted to the comparison element 1, and the driving force of the double-end motor 2 is transmitted to the rotary shaft of the compressor element 1 through the V belt 9. An exhaust duct 12 is formed substantially vertically on the discharge side of the cooling fan 4, and a fin tube type cooler 3 is disposed inside this exhaust duct 12 and above the cooling fan 4. A main duct 11 is formed on the suction side of the cooling fan 4 and between the compressor element 1 and the double-end motor 2 substantially in parallel with the double-end motor shaft. A duct equipped with partition walls 11*a* and 12*a* is interposed between one of the sides of the main duct 11 and the exhaust duct 12 so as to prevent air flowing into the suction side of the cooling fan 4 from mixing with air flowing out from the discharge side. On the other hand, the other end of the main duct 11 is connected to a fin cover disposed on both sides of the fin 23 so that cooling air flowing through the compressor element 1 is guided to the cooling fan 4. The compressor element 1 is connected to the cooler 3 by a conduit 5, and the cooler 3 and a dryer 16 disposed above the compressor element 1 are connected by a conduit 6. In other words, high pressure and high temperature air compressed by the oil-free scroll compressor is subjected to heat-exchange by the cooler 3 with external air and is cooled to air at not higher than 55° C. The dryer 16 constitutes a refrigeration cycle, and the inflow air temperature is limited to not higher than 55° C. Therefore, since the discharge gas of the compressor is pre-cooled by the cooler 3, the dryer 16 can be operated at a suitable temperature.

Reference numeral 32 denotes a casing for accommodating the compressor unit as a whole, and suction ports 17 and 18 and a dryer suction port 19 are disposed on the right side surface of the casing 22, respectively. A dryer exhaust port 20 and an exhaust port 21 are disposed at the upper part of the casing 22.

The air flow for cooling the compressor element 1 and the cooler 3 in the oil-free scroll compressor according to the present invention having the construction described above will be explained. When the double-end motor 2 is turned on, the cooling fan 4 rotates simultaneously with the double-end motor 2, and cooling air is sucked into the casing from the suction ports 17 and 18 formed on the right side surface of the casing 22. Outside air sucked into the casing cools the double-end motor 2 and the compressor element 1 disposed in the proximity of the suction ports 17 and 18.

Fins 23 are formed on both side surfaces of the compressor element 1. Therefore, cooling air flowing in from the suction port 18 flows through the side portions of the compressor element 1 while the fins 23 function as a guide. Then, cooling air flows into the main duct 11 through the cooling air outlet 1*a* formed at the lower portion of the compressor element 1, and is subsequently sucked by the cooling fan 4 from the main duct 11 through the flow passage between the partition walls 11*a* and 12*a*. Outside air sucked from the suction port 17 flows in the axial direction through the peripheral portion of the double-end motor 2 and flows into the cooling fan 4 from the outflow port defined in the partition wall 11*a* disposed on the cooling fan fitting end side of this double-end motor 2. Therefore, a part the cooling air sucked into the casing 22 cools the compressor element 1 and then passes through the main duct 11 and flows into the cooling fan 4, while the remaining cooling air cools the double-end motor and then flows into the cooling fan. After passing through the cooling fan 4, this cooling air is directed toward the cooler 3 for cooling it.

In consequence, the cooler 3 can be cooled by using air after use for cooling the compressor element 1, and excessive cooling air, which is necessary when the cooler and the compressor element are separately cooled, is not required, so that the mass of cooling air can be reduced, the discharge flow velocity becomes lower and the operation noise can be reduced.

Figure 5:
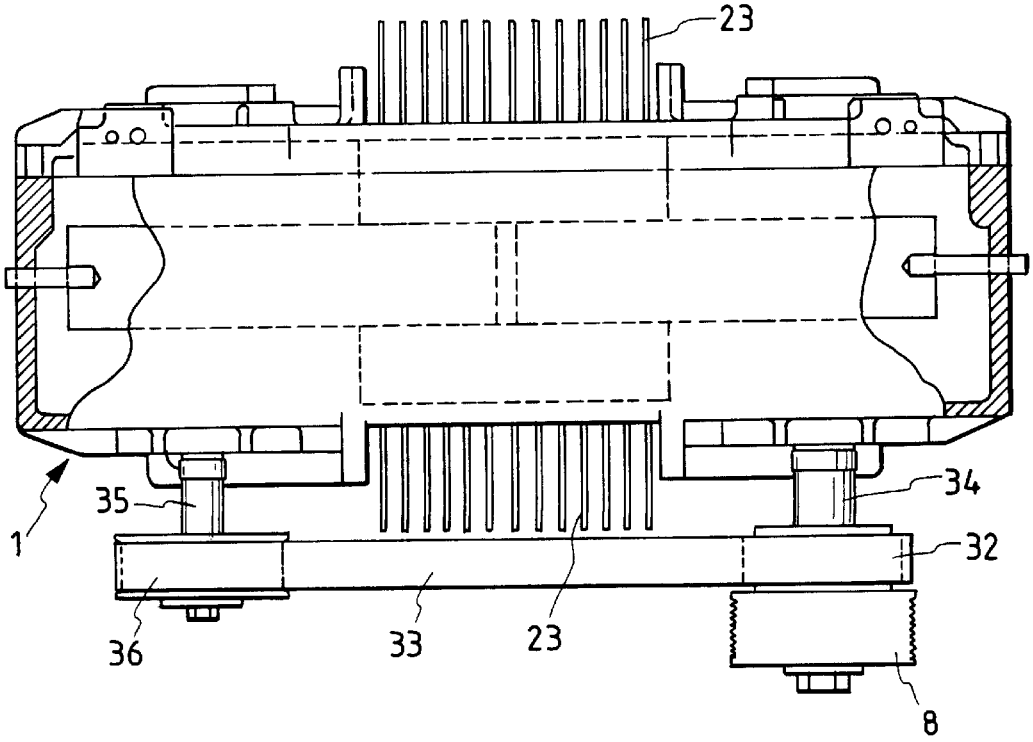
Figure 6:
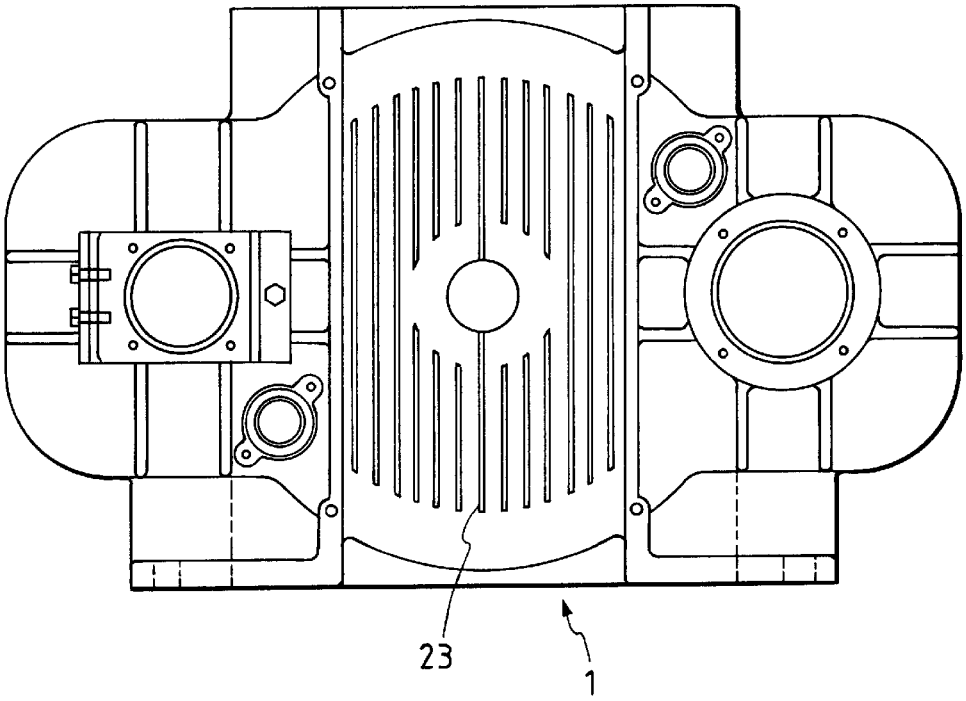

Next, details of the compressor element will be explained with reference to FIGS. 4 to 6.

Figure 4:
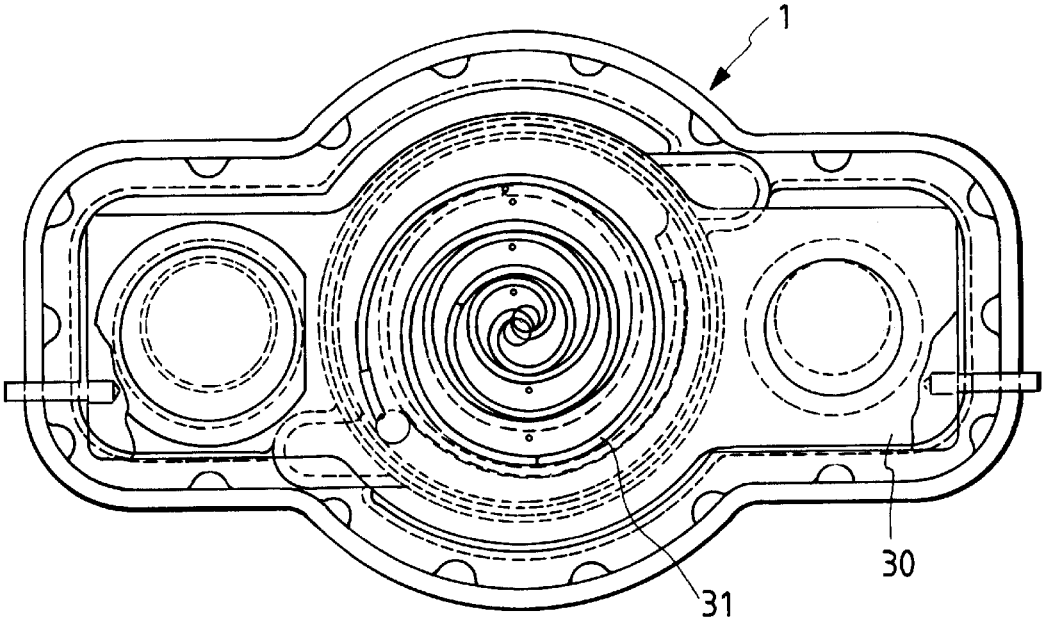

FIG. 4 is a transverse sectional view of the compressor element of the oil-free scroll compressor shown in FIG. 1. FIGS. 5 and 6 are a front view and a bottom view of the oil-free scroll compressor element shown in FIG. 4, respectively. Spiral wraps 31 are formed on both surfaces of an end plate 30 to form an orbiting scroll. This orbiting scroll is sandwiched by two stationary scrolls having spiral wraps formed thereon. Power is transmitted from the double-end motor 2 to a main crank shaft 34 through the pulley 8, and power of the double-end motor 2 is transmitted to an auxiliary crank shaft 35 by timing pulleys 32 and 36 and a timing belt 33 for transmitting power to these timing pulleys.

These two crank shafts are rotatably supported by bearings in the peripheral portion of the end plate not equipped with the wraps, and are also supported rotatably at predetermined positions of the stationary scroll. A fluid section port is provided to the stationary scroll while a discharge port is disposed at the center of the stationary scroll in such a manner as to correspond to the wraps at the peripheral portions of the stationary scroll and the orbiting scroll. When power is transmitted from the double-end motor to the pulley, the crank shaft 34 rotates, and the auxiliary shaft 35, too, rotates in synchronism with the main crank shaft 34 through a timing pulley 32 and a timing belt 33 for synchronization. Due to this rotation, the orbiting scroll rotates with a predetermined radius without turning on its own axis. In consequence, the fluid is sucked from the suction portion into the compressor chamber defined by the orbiting scroll and the wraps of the two stationary scrolls. As the rotation of the orbiting scroll proceeds and the compressor chamber moves from the peripheral portion of the end plate to the center portion, the fluid reaches a predetermined pressure and is then discharged from the discharge port.

During this compression process, the temperature of the operation gas rises and the temperature rise is remarkable particularly at its center portion, which should be cooled. As shown in FIGS. 5 and 6, because the timing pulleys are fitted to the crank shaft in the proximity of both end portions of the compressor element, there is hardly any space, but a sufficient space can be secured at the center exclusive of the discharge port portion of the compressor. Therefore, the cooling fins 23 are formed at this portion. Because the rotary shaft of the double-end motor and the crank shaft are in parallel with each other for the sake of convenience of power transmission, the longitudinal direction of the fins is set to a direction which is perpendicular to both the axis of rotation of the double-end motor and a straight line connecting the axes of the crank shafts. The height of the fins 23 from the casing outer wall of the compressor element 1 is set to a predetermined height in consideration of both of the fluid resistance and the heat radiation capacity. The pitches between the fins 23 are also determined similarly.

Incidentally, it is the double-end motor 2 among the components of the oil-free scroll compressor accommodated in the package casing that has the greatest installation area. Therefore, the compressor can be made compact by defining the outer profile of the casing based on the occupied area of the double-end motor. In other words, because the pulleys and the blower are fitted to both shaft end portions of the double-end motor, the disposition of the other components is determined in such a manner as not to deviate as much as possible from the occupied area of the double-end motor inclusive of these components. Because the motor is heavy and is likely to generate a vibration, etc., it is installed at the lower portion of the compressor.

The lengths of the compressor element 1 and the cooler 3 are not greater than the length of the double-end motor 2, inclusive of the cooling fan 4, in the axial direction. Because the scroll compressor has low vibration and low noise, its influences on the casing are not great even when it is disposed above the double-end motor 2. In order to secure the installation area of the cooler and the cooling flow passages, duct passages are defined between the compressor element and the fan and between the cooling fan and the cooler. In this way, the length in the longitudinal direction of the installation area can be reduced to a minimum and the saving of space can be accomplished.

Incidentally, although the motor base and the duct have separate structures in the embodiment described above, either one of them may double as the other. Further, the embodiment described herein is merely exemplary, but is in no way restrictive, and all modifications utilizing the genuine spirit of the present invention are naturally embraced in the scope of the present invention.

According to the present invention, cooling air flows in the sequence of the compressor element -cooling fan -cooler. Therefore, the mass of cooling air can be reduced, and a lower noise operation can be achieved by reducing the discharge flow velocity.

According to the present invention, further, the principal components of the cooling system, such as the compressor element; and the cooler, are accommodated within the size of the double-end motor inclusive of the cooling fan in the axial direction, and they are disposed above the double-end motor. In consequence, the installation space can be reduced.

What is claimed is:

1. An oil-free scroll compressor comprising:

an oil-free compressor scroll element including an orbiting scroll and a stationary scroll;

a motor for driving said scroll compressor element;

a cooler for cooling an operation gas compressed by said compressor element;

a cooling fan for blasting cooling air subjected to heat-exchange with said operation gas inside said cooler; and a casing for accommodating said compressor scroll element, said motor, said cooler, and said cooling fan;

wherein partition means for partitioning a suction flow passage and a discharge flow passage of said cooling fan are provided in said casing, wherein said cooler is disposed in said discharge flow passage of said cooling fan, and is cooled only by said cooling air, and wherein said scroll compressor element is provided in said suction flow passage and is directly exposed to cooling air therein.

2. An oil-free scroll compressor according to claim 1, wherein said partition means divides the inside of said casing into two chambers.

3. An oil-free scroll compressor according to claim 1, wherein said casing is shaped into a rectangular parallelepiped, said motor is accommodated at the lowermost portion of said rectangular parallelepiped through insulation means for vibration-insulation from said casing, a duct is disposed above said motor, said scroll compressor element is disposed above said duct, a dryer for dehumidifying said operation gas compressed by said scroll compressor element is disposed above said scroll compressor element, said cooler is interconnected to said scroll compressor element, an exhaust port is formed on the ceiling plate side of said casing, a suction port is formed on the side surface of said casing on the side opposite to said cooling fan, and said partition means is an exhaust duct for partitioning said cooler and said cooling fan.

4. An oil-free scroll compressor according to claim 1, wherein said casing contains a first flow passage through which cooling air flows from above to below, an second flow passage through which cooling air flows from below to above and a third flow passage connecting said first and second flow passages.

5. An oil-free scroll compressor according to claim 4, wherein said second and third flow passages are each constituted by a duct respectively.

6. An oil-free scroll compressor according to claim 1, wherein cooling means comprising a plurality of fins are disposed on both side surfaces of said scroll compressor element in a direction perpendicular to the axis of rotation of scroll compressor element.

7. An oil-free scroll compressor according to claim wherein said orbiting scroll of said scroll compressor element is a double scroll equipped with spiral laps on both sides of an end plate.

8. An oil-free scroll compressor according to claim 1, wherein a dryer for dehumidifying said operating as cooled by said cooler is accommodated in said casing, a discharge port for cooling air is formed on a ceiling plate portion for said casing, a suction port of cooling air is formed on a side portion of said casing, and a first flow passage through which cooling air flowing in from said suction port flows from above to below, a second flow passage through which cooling air flows from below in above and whose flow-out end is said discharge port and a third flow passage for connecting said first and second flow passages are exclusively provided to said casing.

9. An oil-free scroll compressor according to claim 8, wherein said second and third flow passages are each constituted by a duct.

10. An oil-free scroll compressor comprising:

an oil-free compressor scroll element including an orbiting scroll and a stationary scroll;

a motor for driving said scroll compressor element;

a cooler for cooling an operation gas compressed by said compressor element;

a cooling fan for blasting cooling air subjected to heat-exchange with said operation gas by said cooler; and a casing for accommodating said compressor scroll element, said motor, said cooler, and said cooling fan;

wherein said motor and said scroll compressor element are disposed in a stratified arrangement, and said cooling fan and said cooler are disposed in a stratified arrangement, wherein said cooler is disposed on a discharge side of said cooling fan, and is cooled only by said cooling air, and wherein said scroll compressor element is provided is directly exposed to cooling air in said casing.

11. An oil-free scroll compressor according to claim 10, wherein said two stratified arrangements are juxtaposed on the floor surface of said casing.

12. An oil-free scroll compressor according to claim 10, wherein cooling means comprising a plurality of fins are disposed on both side surfaces of said scroll compressor element in a direction perpendicular to the axis of rotation of said scroll compressor element.

13. An oil-free scroll compressor according to claim 10, wherein said orbiting scroll of said scroll compressor element is a double scroll equipped with spiral laps on both sides of an end plate.

14. An oil-free scroll compressor comprising:

an oil-free scroll compressor element;

a double-end motor;

a cooler cooled by a cooling fan;

said cooling fan fitted to an end of said double-end motor, and said scroll compressor element driven by an opposite end of said double-end motor;

a duct providing communication between a suction side of said cooling fan and said scroll compressor element;

an exhaust duct with said cooler disposed on a discharge side of said cooling fan;

wherein said cooler is cooled only by cooling air from said cooling fan, and wherein said scroll compressor element is directly exposed to cooling air.

15. An oil-free scroll compressor according to claim 14, wherein said duct and said exhaust duct are so arranged so as to cross substantially orthogonal to each other.

16. An oil-free scroll compressor according to claim 14, wherein said scroll compressor includes a shaft bearing a pulley driven by a belt fitted between the pulley and a shaft on a first end of said double-end motor, wherein a shaft on a second end of the double-end motor drives said cooling fan, and wherein a distance from an end of the shaft of said scroll compressor element bearing the pulley to a free end of said cooler in an axial direction of said motor is smaller than the distance between the shaft ends of said double-end motor.

17. An oil-free scroll compressor according to claim 14, wherein cooling means comprising a plurality of fins are disposed on both side surfaces of said scroll compressor element in a direction perpendicular to the axis of rotation of said scroll compressor element.

18. An oil-free scroll compressor according to claim 14, wherein an orbiting scroll of said scroll compressor is a double scroll equipped with spiral wrap on both sides of an end plate.

19. An oil-free scroll compressor comprising:

a casing;

a double-end motor mounted at a bottom of the casing;

an oil-free scroll compressor element mounted in the casing above the motor, the oil-free scroll compressor element comprising a pair of stationary scrolls, an orbiting scroll mounted between the pair of stationary scrolls, and at least one crank shaft for imparting an orbiting motion to the orbiting scroll, each of the stationary scrolls having an inner surface on which is provided a spiral wrap and an outer surface on which are provided a plurality of fins, the orbiting scroll having an end plate and spiral straps provided on both sides of the end plate;

a pulley for transmitting power from one end of the double-end motor to the at least one crank shaft;

a cooler for cooling an operation gas compressed by the oil-free scroll compressor element;

a cooling fan for blasting cooling air subjected to heat-exchange with the operation gas inside said cooler, the cooling fan being mounted on another end of the double-end motor;

at least one suction port provided in the casing for inflow of cooling air into the casing;

at least one discharge port provided in the casing for discharging cooling air from the casing;

a suction flow passage provided between the at least one suction port and the cooling fan, the oil-free scroll compressor element being provided in a portion of the suction flow passage, the cooling fan sucking cooling air from the at least one suction port and downwardly through the fins provided on the stationary scrolls of the oil-free scroll compressor element to the cooling fan; and a discharge flow passage provided between the cooling fan and the at least one discharge port, the cooler being provided in a portion of the discharge flow passage, the cooling fan forcing cooling air from the suction flow passage, upwardly past the cooler and out the discharge port.

* * * * *